United States Patent [19]

Blatt

[11] Patent Number: 4,881,932

[45] Date of Patent: Nov. 21, 1989

[54] METHOD AND APPARATUS FOR MANUFACTURING PLASTIC FILM BAG WITH SPECIAL FLAP ARRANGEMENT

[76] Inventor: Eli Blatt, 6 Rolling Dr., Brookville, N.Y. 11545

[21] Appl. No.: 163,288

[22] Filed: Mar. 1, 1988

[51] Int. Cl.[4] ..... B31B 1/90; B31B 23/14

[52] U.S. Cl. ..... 493/213; 493/232

[58] Field of Search ..... 493/193–196, 493/212–215, 231, 232, 235, 245, 438; 206/632; 383/86

[56] References Cited

U.S. PATENT DOCUMENTS

| | | | |
|---|---|---|---|
| 3,595,139 | 7/1971 | Adams | 493/235 |
| 3,599,538 | 8/1971 | Piazze | 493/194 |
| 4,022,457 | 5/1977 | Marin et al. | 493/438 |
| 4,355,494 | 10/1982 | Tilman | 493/214 |
| 4,531,723 | 7/1985 | Watson | 271/99 |
| 4,586,318 | 5/1986 | Litt et al. | 53/372 |
| 4,636,191 | 1/1987 | Piggott | 493/926 |

FOREIGN PATENT DOCUMENTS

| | | | |
|---|---|---|---|
| 2145284 | 3/1973 | Fed. Rep. of Germany | 493/194 |
| 2345355 | 10/1977 | France | 493/212 |

*Primary Examiner*—Frederick R. Schmidt
*Assistant Examiner*—Jack W. Lavinder
*Attorney, Agent, or Firm*—Roberts, Spiecens & Cohen

[57] ABSTRACT

Apparatus and methods are provided for manufacturing plastic film bags with two-piece flaps. A slitting tool slits the flap portion of a longitudinally displaced film strip arrangement and a spacing tool displaces one of the resulting sections to form a gap. Thereafter, an adhesive hearing tape is applied to bridge the gap and connect the separated sections. After this, a cutting tool cuts notches into the two-piece flap portion which is lifted for this purpose by a Teflon-coated template having a slot to receive the cutting tool. The template has a channel system to enable blowing away the cut out portion. The separate bags are formed by sealing and severing at a position to intersect the notches. The method of the invention involves cutting the notches into the flap section to delineate separate flaps and associated bags in a time frame which follows the folding of the flap section over the main body of the bag. Also the method of the invention comprises loading the goods into the bag through an open end with the mouth of the bag being closed by the associated flap. Thereafter, when access to the goods is desired, the flap may be opened to open the associated mouth, the previously open end which is loading the bag having been closed by heat sealing to some other suitable technique.

11 Claims, 6 Drawing Sheets

METHOD AND APPARATUS FOR MANUFACTURING PLASTIC FILM BAG WITH SPECIAL FLAP ARRANGEMENT

FIELD OF INVENTION

This invention relates to methods and apparatus for the manufacture of plastic film bags and, more particularly, to methods and apparatus for the manufacture of plastic film bags having special flap arrangements with improved adhesive provision. The invention also relates to methods of fillings bags.

BACKGROUND

Many provisions have been heretofore proposed with regard to the development of plastic film bags manufactured, for example, of film strips of polyethylene or the like. Some developments have been shown for bags and envelopes in general in U.S. Pat. Nos. 2,066,495; 2,131,575; 2,330,666; 2,991,001; 3,026,018; 3,203,621; 3,670,947; 3,990,627; and 4,415,087.

W. E. Swift in U.S. Pat. No. 2,066,495 reveals an envelope having correspondingly shaped areas of its seal flap and body coated with a dry- sealing adhesive. An apertured portion of the envelope body is disposed beween the adhesive areas to maintain the adhesive areas out of engagement. Sealing of the envelope is effected by pressing portions of the adhesive areas into contact through the apertured portion. In this arrangement, the flap is fabricated of a monolithic piece provided with the aforesaid apertures and there is further provided a cooperating adhesive on the envelope itself, which cooperating adhesive along with the first noted adhesive is of such a character that it will adhere upon non-moistened contact to the other adhesive, although it will not adhere to the material of which the envelope is made.

C. R. Whipple in U.S. Pat. No. 2,131,575 reveals an envelope which includes a pocket and a flap for closing the pocket which normally overlies a part of the rear wall of the envelope. Adjacent faces on the flap and on the rear wall of the envelope have complementary areas coated with an adhesive of the type which will adhere to itself upon the application of pressure alone, but will not adhere to the uncoated parts. The adhesive coating on at least one of the parts has uncoated areas adjacent to the coated areas which are disposed out of the normal plane of the coated areas for normally maintaining the coated areas on the two parts in spaced relation. The coated areas on the respective parts are adapted to be brought into adhering by the application of pressure to the overlying coated areas.

In U.S. Pat. No. 2,330,666, E. B. Berkowitz reveals a quick opening envelope formed of fibrous material including a body portion and a seal flap portion extending along an opening in said body portion through which contents of the envelope may be emptied. A gum repellent coating on one of the portions is provided, contacting the other portion when the seal flap portion is in sealed position. The portion provided with the gum repellent coating has restricted uncoated sealing spaces within the coated area. Gum between the portions for effecting seal at the restricted spaces is provided. Substantially arcuate cutting edges are provided by the coating on sides of the sealing space nearest the opening for severing any fibers which are embedded in the gum when the flap portion is pulled loose while opening the envelope.

W.L. Hughes in U.S. Pat. No. 2,991,001 discloses a resealable container. This container has a body portion and an entrance at one end of the same. A resealing arrangement is provided which overlies a peripheral resealing path defined by perforations in the container. Further included is a tear strip adjacent the exterior or the resealing path and protruding into the container. A pressure-sensitive tape overlies the tear strip and the resealing path. The tear strip is disengageable from the tape to tear and remove the resealing path and thus expose pressure sensitive portions of the tape for mutual adhesion and resealing of the container.

E. Stratton reveals in U.S. Pat. No. 3,026,018 envelopes having gummed flaps formed with tape. More particularly, an envelope is provided which includes a front and a back joined at their peripheral edges to form an envelope pocket. A flap is hinged to the front along a fold line. This flap is swingable above the fold line to close the envelope pocket. Longitudinally projecting portions formed integrally with the bag and positioned at opposite ends of the fold line are provided. The longitudinally projecting portions extend across the lines of fold between the front and the flap, and are in adhering relationship to the flap in order to strengthen the envelope at the opposite ends of the line of fold.

D. Wright in U.S. Pat. No. 3,203,621 reveals a bagtop closure made of paper, folded along a crease to form two panels. Each of these panels has a substantial portion of its inside surface coated with an adhesive composition such as, for example, water-soluble adhesive compositions and heat sensitive thermoplastic adhesive compositions. The adhesive coating on one of the panels is rendered ineffective except for a small area by a patterned application of a superimposed coating of a permanent masking agent. In this arrangement, an attached tab depends from the bottom edge of the masked panel and employs an adherent coating of a pressure-sensitive adhesive composition.

A hanger bag with a flap closure is shown by A. Tangredi et al in U.S. Pat. No. 3,670,947. This hanger bag is formed from a single, elongated sheet of flexible thermoplastic film by cutting a series of spaced-apart notches in one of the longitudinal edges of the film. The distance between the notches is the desired width of the finished bag. The opposite longitudinal end of the sheet is doubled back to the desired height of the finished bag. The notched edge is folded over the opposite edges and a hanger or handle member is heat sealed to the upper folded-over edge between the spaced-apart notches. Thereafter there is effected the step of heat sealing and severing the folded film transversely, with the heat seal passing through the notch whereby a finished bag is formed. This arrangement employs a pressure sensitive tape to keep the flap secured. The flap is itself in the form of a monolithic structure.

In U.S. Pat. No. 3,990,627, R. Olson discloses an adhesive closure for bags, including an adhesive stripe located adjacent the open mouth portion of the bag. The adhesive stripe is covered until ready for use by the upper portion of the bag's front wall whereby upward displacement of the front wall exposes the adhesive stripe for sealing the upper portion of the bag walls together.

W. Clayton et al reveal in U.S. Pat. No. 4,415,087 an improved adhesive system for forming releasable channel closures for flexible bags. The adhesive system includes a layer of hot melt adhesive over which a thin second layer of a liquid-based adhesive such as a water-based pressure sensitive acrylate is applied.

None of the aforegoing patents reveal the provision of a flap portion consisting of two entirely separate sections, separated by a gap which is bridged by a tape bearing thereupon a pressure-responsive adhesive as will be discussed in further detail hereinbelow.

SUMMARY OF THE INVENTION

It is an object of the invention to provide improved methods and apparatus for the manufacture of flap-closeable bags or envelopes.

It is another object of the invention to provide improved mass productions techniques and apparatus for the manufacture of improved plastic bags or envelopes fabricated of plastic film such as polyethylene or polypropylene.

It is yet another object of the invention to provide improved methods and apparatus for the manufacture of bags incorporating a pressure-responsive adhesive arrangement for the sealing of bags my means of associated flaps hingedly connected thereto.

For achieving the above and other objects of the invention, there is provided a method of forming a bag or envelope (the terms are used interchangeably in the following) of plastic film, the bag being provided with a mouth and with a hingably connected flap to close the mouth. An improvement of the invention involves generally separating the flap into separate sections spaced by a gap therebetween and connecting the sections with an adhesive which is exposed through the gap to adhere to the bag itself. The adhesive employed in accordance with the invention is preferably supported on one face of a tape and is constituted, for example, by a Scotch tape. The aforementioned gap is bridged by and with the tape so that the tape adheres to both the sections and connects the flap sections together.

As will be shown below, the bag may be fabricated of two plastic film sheets which are sealed together or may be formed of two pieces which are formed by folding a single piece to form two face-to-face parts. The flap is hingedly connected to one of the pieces. As will also be mentioned hereinbelow, the film pieces have generally ink-receptive outer surfaces formed thereon by appropriate well known treatment. However, in accordance with the invention, the surface of one of the pieces forming the bag body portion against which the flap is folded is so treated as to provide an area corresponding to the abovementioned adhesive which is not ink receptive. The purpose of this is to prevent the adhesive from adhering to the bag body portion and becoming detached from the tape itself.

In accordance with a feature of the invention, the strips of plastic film are longitudinally displaced along a processing path in face-to-face relationship. The first of the strips is wider than the second of the strips and includes a flap portion which may be folded back along an edge portion of the second strip with a strip of adhesive bonding the flap portion to the edge portion. According to a feature of the invention, a template is inserted between the flap portion and edge portion at a cutting station for lifting the adhesive from the edge portion at the cutting station. Thereafter, wedge shaped notches are cut out of the flap portion by sandwiching the flap portion between the template and a cutting tool reciprocal at the cutting station. The flap portion is then pressed against the edges portion and the film strips are sealed to each other along lines transverse to the path and in intersecting relationship with the notches. The cut-away portions of the flap portion are blown away in a method step which utilizes the template as discussed hereinbelow.

As will also appear hereinbelow, and as has been heretofore mentioned generally above, the flap portion is divided into spaced flap sections separated by a gap with the method of the invention further comprising connecting the sections by a strip, including a substrate with a pressure-responsive adhesive thereon which is exposed through the gap to constitute a utilizable strip of adhesive.

As a feature of the invention the wedge-shaped cut-away portions forming the notches are formed as isosciles triangles.

In accordance with the invention and as mentioned above, there is provided an improved apparatus. This apparatus provides for cutting notches into a flap portion of first and second elongated strips of plastic film which may be completely separate from one another, or which may be connected along a fold line. The strips of plastic film are longitudinally displaced in face-to-face relationship along a path of travel, and one of the strips includes a flap portion folded around an edge portion of the second of the strips, with the flap portion being separately bonded to the edge portion along a linear strip of adhesive extending in parallel to the elongated strips. The apparatus of the invention includes a template arrangement inserted between the flap portion and edge portion at a cutting station, thereby separating the adhesive from the edge portion at the station. A cutting arrangement is reciprocal against, and away from, the thusly inserted template arrangement at the cutting station, to cut wedge shaped notches into the flap portion sequentially and at spaced positions along the flap portion.

As will be disclosed in greater detail hereinbelow, the template arrangement includes a flat, preferably teflon-coated plate having a channel therein corresponding to the wedge shape notches. The plate preferably has a thickness, for example, in the order of magnitude of about one eighth of an inch.

The apparatus is arranged to provide that the wedge shape notches are preferably symmetrical and there is furthermore provided in this apparatus an arrangement for sealing and severing the strips along lines transversely disposed with respect to the strips and in bisecting relationship with the notches.

As will be seen hereinbelow, the cutting arrangement includes a first part for clamping the flap portion against the template arrangement, and a second part guided by and displaceable relative to the clamping part for cutting the notches. The second part will be shown to include a serrated cutting implement of generally triangular form.

In accordance with yet another feature of the invention, there is provided an apparatus for forming a gap between sections of flaps forming a part of an arrangement adapted for closing the mouths of plastic film bags. This apparatus comprises a source of elongated plastic film strip adapted for being displaced and transported along a path of processing. A cutting arrangement is positioned along the path to sever an edge portion of the film strip and a spacing arrangement is positioned along the path to force the edge portion of the strip away from the remainder of the strip to form a gap therebetween. In addition, there is provided a driving arrangement to draw the strip along the path for engagement by the cutting and spacing arrangements and there is, moreover, provided an arrangement to apply a tape including pressure responsive adhesive across the gap to bridge the same and bond the edge portion to the remainder of the film.

As a feature of the aforesaid apparatus, there is provided a folding arrangement to fold over a portion of the strip including the edge portion, and a part of the remainder of the strip to form a flap portion and a body portion extending along the path. As will have been noted, the flap portion includes sections connected by the aforementioned tape.

In this latter arrangement, the aforesaid template is arranged a long the path to be interposed between the flap and the bag body portions, and a cutting arrangement is reciprocal towards and away from the template to cut notches into the flap portion along equally spaced positions along the flap portion.

In addition to the above and as will be shown hereinafter, there is provided a sealing arrangement to seal the body portion to a further film strip along lines transverse to the aforementioned path and to bisect the notches thereby to form separate bags.

It is a further object of the invention to device an improved technique for the manufacture of bags provided with flaps. In accordance therewith, the method comprises forming a plastic film into face-to-face film sections, one of these sections including a portion extending beyond the other of the sections. The method further includes folding this portion over said other section to form a flap section and, subsequent to said folding, cutting notches into the flap section to delineate separate flaps and associated bags. Thereafter, the bags are separated from each other.

In further accordance with this feature of the invention, the flap section, as noted above, connected to said other section with an adhesive before the cutting of said notches and then a templet is as noted above inserted between the flap section and said other section to permit the cutting of the notches while shielding the other section from abrasion and undesired cutting. Moreover, as will be seen, the method comprises periodically trapping the flap section between the template and a cutting tool to effect the cutting of notches sequentially in spaced relation along the flap section.

According to yet another object of the invention, there is provided a method for the loading of goods to be packaged into a bag. This method comprises forming a bag with a mouth and a closable, but open, zone, spaced from the mouth, closing the mouth with a flap, inserting goods to be packaged into the bag through the open zone, and then closing the open zone to enclose the goods in the bag.

Features of the above method include thereafter opening the flap and removing the goods through the thusly opened mouth, and possibly forming the open zone in an end of the bag which is opposite to the mouth. The bag is, as indicated hereinabove, formed of a plastic film and the aforesaid zone may closed by heat sealing.

Other objects, features and advantages of the invention will be found in the detailed description which follows hereinbelow as illustrated in the accompanying drawings.

BRIEF DESCRIPTION OF DRAWINGS

In the drawing:

FIG. 1(*a*) is a fragmentary cross-sectional view of said tape;

DETAILED DESCRIPTION

Figure 1:
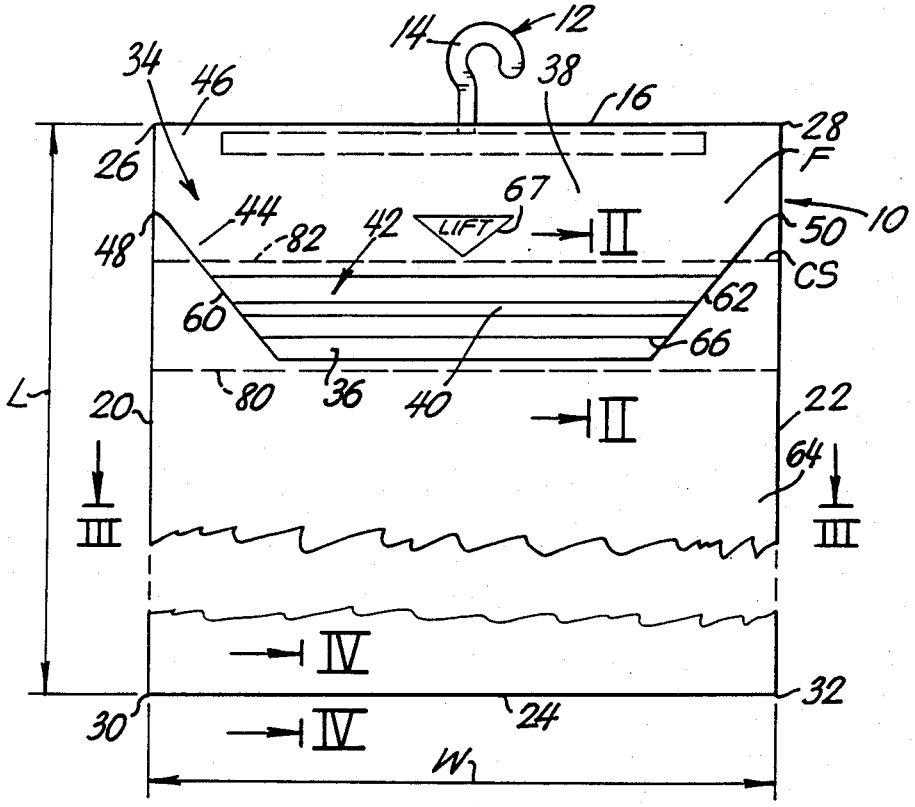
FIG. 1 is a partially broken away view of one face of a bag or envelope provided in accordance with the invention and including a flap portion configured as two separate sections connected together by a tape.

FIG. 1 of the drawing illustrates an envelope or bag 10 provided at the top thereof with a hanger indicated generally at 12. The hanger is not a basic feature of the invention and may be provided in any conventional form. I may be provided by passing the hanger handle 14 through a slot (not shown) at the upper edge or end 16 of the bag 10 as disclosed in U.S. Pat. No. 3,429,498 which issued to J. Dorfman on Feb. 25, 1969, or it may be, for example, provided by being attached by a seal as shown in U.S. Pat. No. 3,670,947 which issued June 20, 1972 to A. Tangredi et al.

The bag (or envelope) has an interior pocket in which may be accommodated typically software items, such as pajamas, blouses and shirts or the like, which are displayed through the transparent material of which the bag is made. The bag 10 is, for example, made of a flexible material, such as plastic film and, more particularly, polyethylene or polypropylene film having a thickness of, for example, from about 0.0005 to 0.020 inches. The aforegoing materials are mentioned by way of example only as the envelopes or bags of the invention may be fabricated from other materials both natural and synthetic and including such materials as paper, cloth, and so on which are preferably plasticized and shape-retentive to the extent which will be apparent from the following description.

As has been noted above, the bag 10 has a top end or edge 16. This edge constituted usually by a fold line, the material from which the bag is constructed being doubled over at this edge or end. The bag, furthermore, has lateral edges 20 and 22, and a bottom end or edge 24. The lateral edges 20 and 22 are preferably seal lines which are formed during the continuous manufacture of a series of bags. Bedore sealing, there are adjacent bags attached along edges 20 and 22. Sealing as well as severance takes place in a conventional manner during the process to be described hereinunder. The width of the bag is indicated at W. This width may be selected according to need, and is easily and readily adjusted in the manufacturing process. A portion of the bag is broken away to show also that the length or height of the bag indicated at L is also easily varied during the manufacturing process.

As is apparent from the drawing, the bag is of rectangular configuration in the preferred embodiment. It therefore has four corners as indicated at 26, 28, 30 and 32. The bag also includes a flap portion 34 which has a construction constituting an important feature of the invention. First of all, it will be noted that the flap portion 34 consists of two flap sections 36 and 38, which are physically separated from one another by a gap 40 (for example, 0.030 to 1.00 inches wide) which is bridged by a tape indicated at 42. The flap section 36 has a trapezoidal configuration. The flap portion or section 38 has a downwardly located section or part 44 which is likewise of trapezoidal configuration, this trapezoidally configured part being connected to an upper section 46 which may be regarded generally as having a rectangular configuration extending between lateral edges 20 and 22 and connected to fold line 16. Trapezoidal section 44 is monolithic with rectangular section 46 as indicated at points 48 and 50.

Figure 1A:
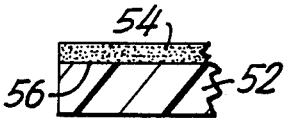

The tape 42 which will be discussed in greater detail hereinbelow, is preferably a Scotch tape of commercially available type. Such a tape as illustrated in FIG. 1a consists of a substrate 52 atop of which is located a pressure-responsive adhesive 54. The surface of the substrate 52 which is coated is indicated at 56 and, in accordance with the invention, the adhesive is preferably applied to only one face, as illustrated. Pressure-responsive adhesives and suitable substrates such as cellophane, plastic, and the like are commercially available and well known for application in the invention. However, it should be noted that the substrate 52 of the tape to be applied to flap portions of bags of the invention adds some thickness to the flap portion at gap 40 and forms a composite material which is generally more shape-retentive than the plastic film of which such bags are manufactured. The softness and pliability of the bag material nevertheless allow ready conformation to the objects which are to be packaged in such bags, whereas the shape-retentive quality added by the Scotch tape enables reinforcing the bag material where the tape is applied. this avoids puckering during and after the manufacture of the bag to facilitate sealing, opening and resealing of the mouth of the bag body located at the fold line 16.

Figure 2:
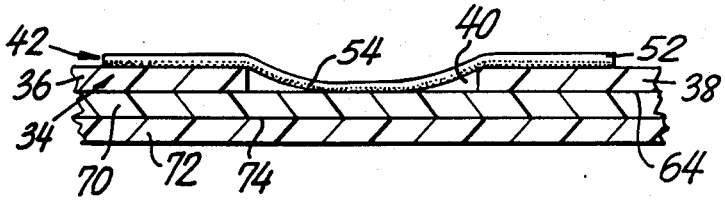
FIG. 2 is a cross-sectional view taken along line II—II of FIG. 1.

It will be noted that the tape 42 is trimmed at 60 and 62, thereby giving the tape a trapezoidal configuration conforming to that of adjacent portions of the flap portions 36 and 38. It will also be noted that the tape extends entirely across the flap portion at the portion to which the tape is connected. In FIG. 2 and in accordance with the invention, the tape is superposed on the flap portion 34 with the adhesive 54 being exposed downwardly through the gap 40 and thereby constituting an adhesive strip which is employed for sealing the flap portion against the upper surface of the bag as indicated at 64.

A printed triangle is indicated at 67. This triangle is provided by application of a printing ink. Within this triangle is indicated a legend, such as LIFT or LIFT TO OPEN or some other such text which will indicate to the user of the bag the precise area in which the seal exists. Thus the portion or section 36 constitutes a well identified, readily liftable section hingeable at the bottom extremity 66 of gap 40, thereby facilitating initiation of lifting of the flap portion whereby the bag may be opened.

FIG. 2, noted above, illustrates a broken away portion of the bag of FIG. 1 in section and somewhat diagrammatically. In FIG. 2 appears the tape 42 with substrate 52 to which adheres the pressure-responsive adhesive 54. The gap is, once again, indicated at 40 and in this figure appear the two layers or film sections 70 and 72 with line 74 indicating the pocket of the bag within which may be stored suitable objects such as mentioned above. The flap portion is, again, indicated at 34 with its sections 36 and 38. The adhesive is exposed through the gap 40 and is applicable, as noted hereinabove, to the surface 64 of film section 70 to be able to adhere to the same and to provide for a temporary seal thereby bonding the flap portion 34 temporarily to the surface 64.

In general, the outer surfaces of the film from which the bag is manufactured are treated, for example, as indicated in U.S. Pat. No. 3,348,762 (Kasinkas) to form an oxidized strip. This has two effects. One effect is to make the treated surfaces more ink-receptive, thereby to permit and facilitate a printing of text material and art work on the bags so treated. The oxidation is formed by a processing which a gap voltage, generated in the air between an electrode and the bag, ionizes the ambient air proximate to the bag. The ionized ozone thus formed acts as an oxidizing agent and the oxidized surface has the desired ink receptive characteristics.

In accordance with the invention, it is preferred that a strip corresponding to but exceeding the gap 40 and the pressure-responsive adhesive exposed therethrough be relieved of such ink receptive characteristics, as it has been found that this prevents the adhesive on the substrate from being more or less permanently bonded to the surface 64, thereby to be undesirable removed from the tape 42. To this end, there is provided during the pretreatment, a strip or area whose limits are indicated at 80 and 82. This portion is devoid of oxidation and ink receptive characteristics and thereby lacks the characteristics causing it to bond more permanently to the exposed adhesive of the tape 42. This greatly facilitates the opening and closing of the flap portion 34 and allows the adhesive 54 (see FIG. 1*a*), to adhere permanently to substrate 52 whereby opening and closing of the flap portion are permitted in repetitive fashion.

Figure 3:
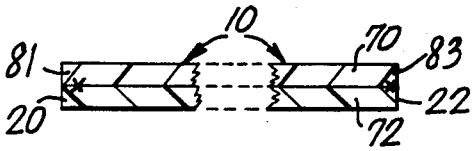
FIG. 3 is a cross-sectional taken along line III—III of FIG.1.

FIG. 3 is a cross section of the bag taken along line (III—III) of FIG. 1. This figure illustrates the film sections 70 and 72 and furthermore illustrates at 81 and 83 the sealing which is affected at the lateral edges 20 and 22 of the bag 10.

Figure 4:
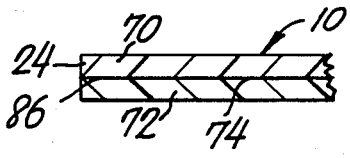
FIG. 4 is a cross-sectional view taken along line IV—IV of FIG. 1.

FIG. 4 is a cross sectional view taken along line IV—IV of FIG. 1. The figure also illustrates film sections 70 and 72 as well as bottom edges 24 of bag 10. In this embodiment of the invention, the pocket 74 is open and there is no seal provided in zone 86. This means that the bottom edge 24 of the bag 10 is open and that an insertion of objects into such bags may be effected from the bottom end, which is thereafter sealed in any conventional manner.

Figure 5:
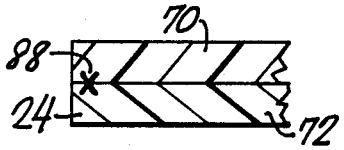
FIG. 5 is a cross-sectional view corresponding to FIG. 4, illustrating a further embodiment of the invention.

FIG. 5 illustrates a variation of the aforegoing embodiment in which layers 70 and 72 are sealed, as indicated at 88, to close off the bottom edge 24. This sealing as illustrated in FIG. 4, but may alternatively be effected during the manufacturing process. This closure may, in fact, be simply a fold-over operation by which the bottom edge of the bag 10 is closed. In this case, insertion of objects into the bags must take place from the mouths at the tops of the bags, according to another embodiment of the invention.

As pointed out by W. Clayton in U.S. Pat. No. 4,415,087, bags with adhesive closures advantageously are adjustable to the size of the object contained therein. Clayton, however, points out that it has been difficult to find a satisfactory adhesive which is suitable for use with recloseable plastic bags such as those made from polyethylene and polypropylene film. U.S. Pat. No. 4,415,087 points out that an adhesive which adheres adequately to a polyethylene surface may form a seal that is not easily reopenable without destruction of the closure or a portion of the bag, while an adhesive that forms a resealable closure may not adhere sufficiently to a base film or closure strip.

U.S. Pat. No. 4,414,087 further points out that attempts at finding adhesives suitable for use in constructing releasable closures for flexible bags have involved certain problems including that the adhesives are not easily applied at high speeds without need of a drying step. Moreover, the strength of the adhesives may be reduced during processing, which is also unsatisfactory.

Another problem pointed out is that many adhesives, which have been tried, did not form a satisfactory bond to polyethylene film or the like. These adhesives may be removed during the opening of the bag, leading to a deterioration of the related seals after a number of openings and resealings. Bag formed in accordance with the instant invention, however, avoid these problems. The adhesive adheres permanently to the substrate from which the adhesive is not detached during repeated openings and closing of the flap portions of the bags of the invention. This result can, moreover, be enhanced by clearing away a portion of the ink receptive surface as noted above. Moreover, the tape substrate adds to the shape-retentive characteristics of the adjacent flap portions, thereby preventing puckering and other such deformations.

Figure 6:
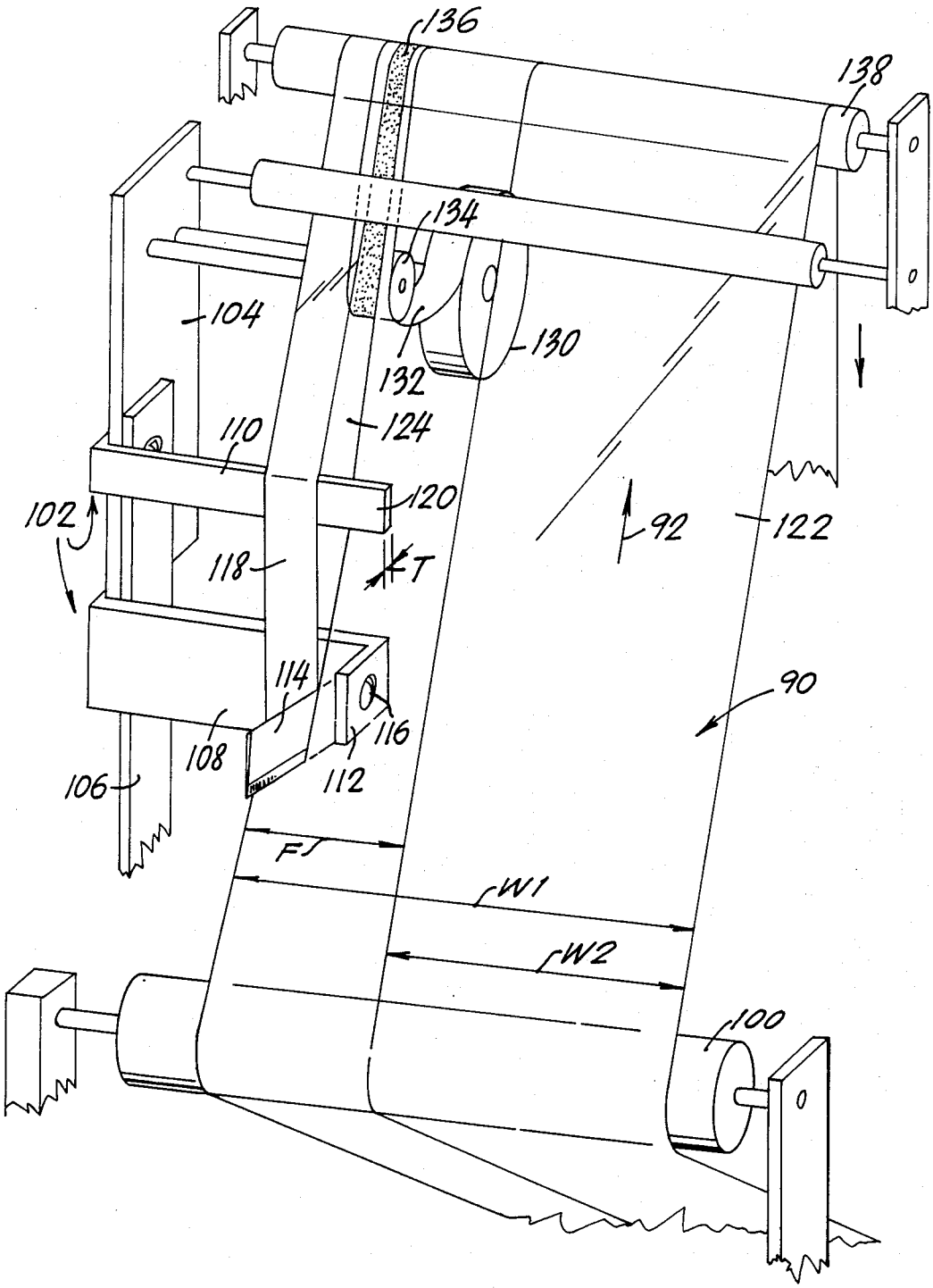
FIG. 6 is a perspective view of an apparatus for separating a flap portion into separate sections with a gap therebetween and for applying an adhesive tape thereto.

The remainder of the figures of the drawings illustrate the apparatus and method by means of which bags of the invention can be produced. In the apparatus and methods of the invention there is employed the continuous feeding of one or more strips of polyethylene or polypropylene or the like, thereby to effect mass production techniques. In FIG. 6, for example, is illustrated a continuously moving arrangement of a strip or a plurality of face-to-face strips indicated at 90 and longitudinally displaceable in the direction indicated by arrow 92. The strip arrangement is indicated with two widths W1 and W2. Width W2 indicates the height L of the film section 70 previously discussed relative to FIGS. 1–5. Width W1 indicates the height L plus an amount necessary to form a flap. Bag sections 70 and 72 may be provided as separate film sections provided from separate sources (not shown). Alternatively, film sections 70 and 72 may be provided from a single film which is folded over to provide a partial overlap with the additional section having a breadth indicated at F in FIG. 6 and constituting the flap portion 34 ultimately to be formed, as indicated in FIG. 1.

The film strip arrangement 90 passes, for example, over a roller indicated at 100. This roller may be an idling roller which is not positively driven other than by the passage of the film strip arrangement thereover. At least one of the rollers, however, arranged along the path of travel 92 of the film strip arrangement of positively driven, so that the film strip arrangement 90 is held under tension free of undulations, puckers, folds or the like and with a speed consistant with the notching or cutting or sealing to be mentioned hereinbelow.

At 102 in FIG. 6 is indicated a cutting arrangement spacing station. Thereat is provided a fixed base 104 bearing thereon a support beam 106 to which is affixed an angle 108. An angle 110 is also affixed between the support beam 106 and the fixed base 104. To the outer flange 112 of the angle 108 is affixed a slicing tool such as a razor blade or the like. The razor blade is indicated at 114 and is affixed to the flange 112 by a fastening member such as screw or nut and bolt arrangement as indicated at 116. The slicing tool 114 is arranged to make an incision to sever away a portion indicated at 118. This portion is the portion from which flap section 36 will ultimately be formed, as will be described hereinbelow. The portion 118, which remains connected to the film strip arrangement 90 upstream of the slicing tool 114, is passed around a spacer element indicated at 120. The purpose of this spacer element is to displace the portion 118 from the main body of the film strip arrangement 90 by a gap 124 which corresponds to the gap 40 in FIG. 1. This gap is retained, as is the relative position of the portion 118, by the tension under which the film strip arrangement 90 is placed by having one or more positively driven rollers to displace the film strip arrangement 90 along its path of processing.

The width of the gap 124 may be controlled by the thickness T of the spacer element 120 and by the angle of insertion thereof in the gap 124. Both the slicing tool 114 and the spacing tool 120 are shown by way of illustration only and various other types of tools made of various materials such as metal or the like are clearly useful to serve the respective objects of these tools in accordance with the invention.

At 130 is indicated a source of Scotch tape or other equivalent tape having a suitable substrate with a pressure-responsive adhesive or the like positioned preferably on only one face thereof. The continuous tape is indicated at 132 and is guided into contact with the film strip portions 118 and 122 by a guide roller 134. The adhesive on the tape 132 is brought into engagement and bonds to the film strip arrangement with a part of the adhesive being exposed upwardly, as indicated at 136, to constitute the exposed adhesive which will ultimately be used for the repetitive sealing of the resultant bags. The aggregate thus formed is passed over a guide roller 138 thereafter proceeding to the station indicated in FIGS. 7 and 8.

Figure 7:
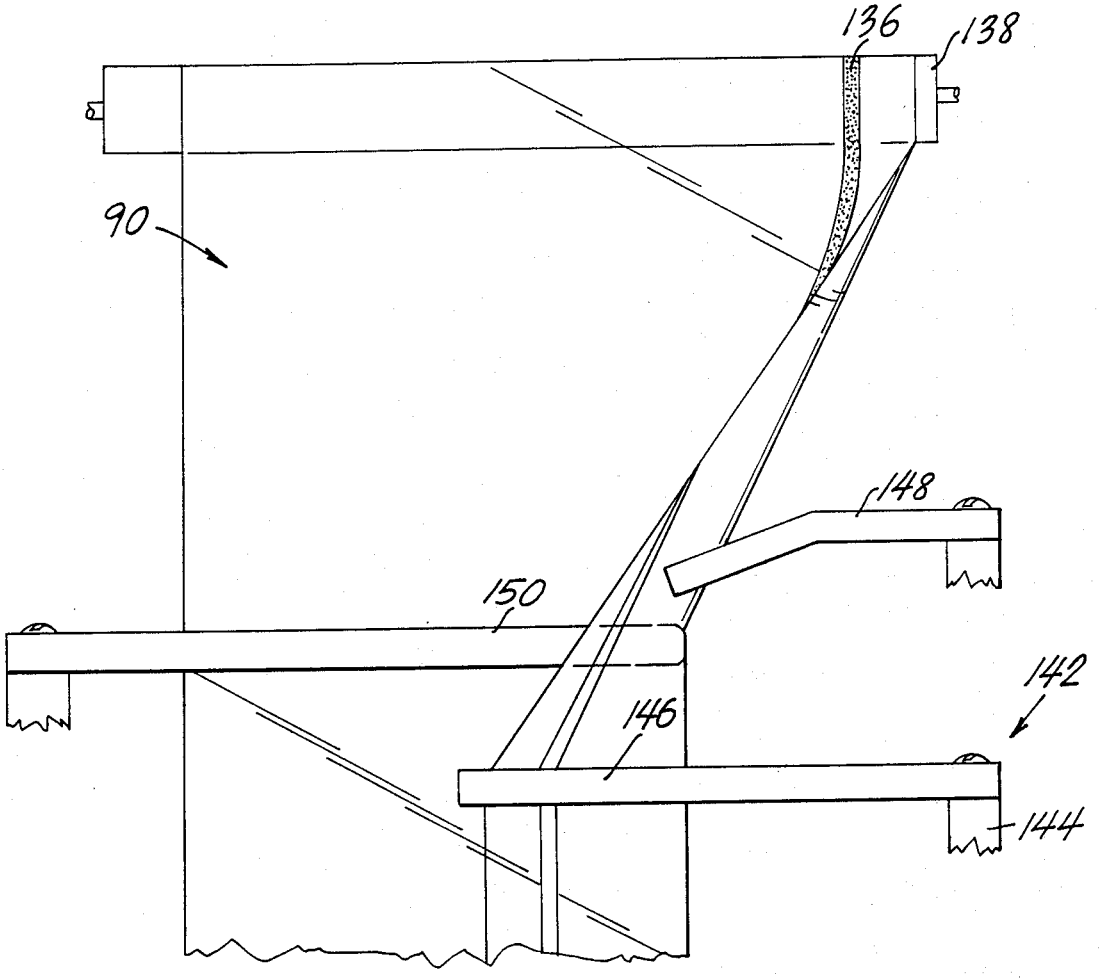
FIG. 7 is a view showing a continuation of the apparatus of FIG. 6, with provisions being made for folding over the flap portion of the film being processed.
Figure 8:
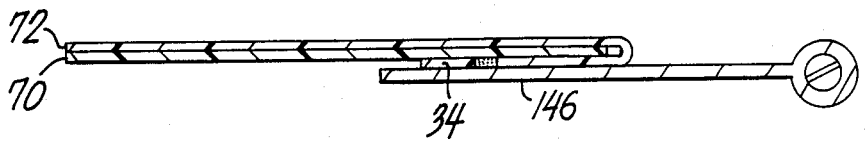
FIG. 8 is an enlarged view, partially in section, showing a detail of the apparatus of FIG. 7.

In FIGS. 7 and 8 the film strip arrangement 90, including exposed adhesive strip 136, is shown as passing over a guide roller 138 over which the film strip arrangement 90 passes on its way to folding station 142. The folding station 142 consists of a support 144 bearing a folding arm 146. An arm 148 is also included for guiding the folding over of the flap the and an arm 150 displaced therefrom is inserted under the flap. In the setting up process, the film strip is taken from the roller 138 by manual manipulation and the flap is folded over and brought between arms 148 and 150 and then past arm 146. The flap portion F is thereby folded over, (shown inverted in FIG. 8) thereby giving rise to portions 34, 70 and 72 as has been previously discussed relative to FIGS. 1–5. The thusly formed arrangement then proceeds to the cutting station illustrated in FIG. 9, with the flap section F or 34 bonded by adhesive 136 to the film sheet or section 70.

Figure 9:
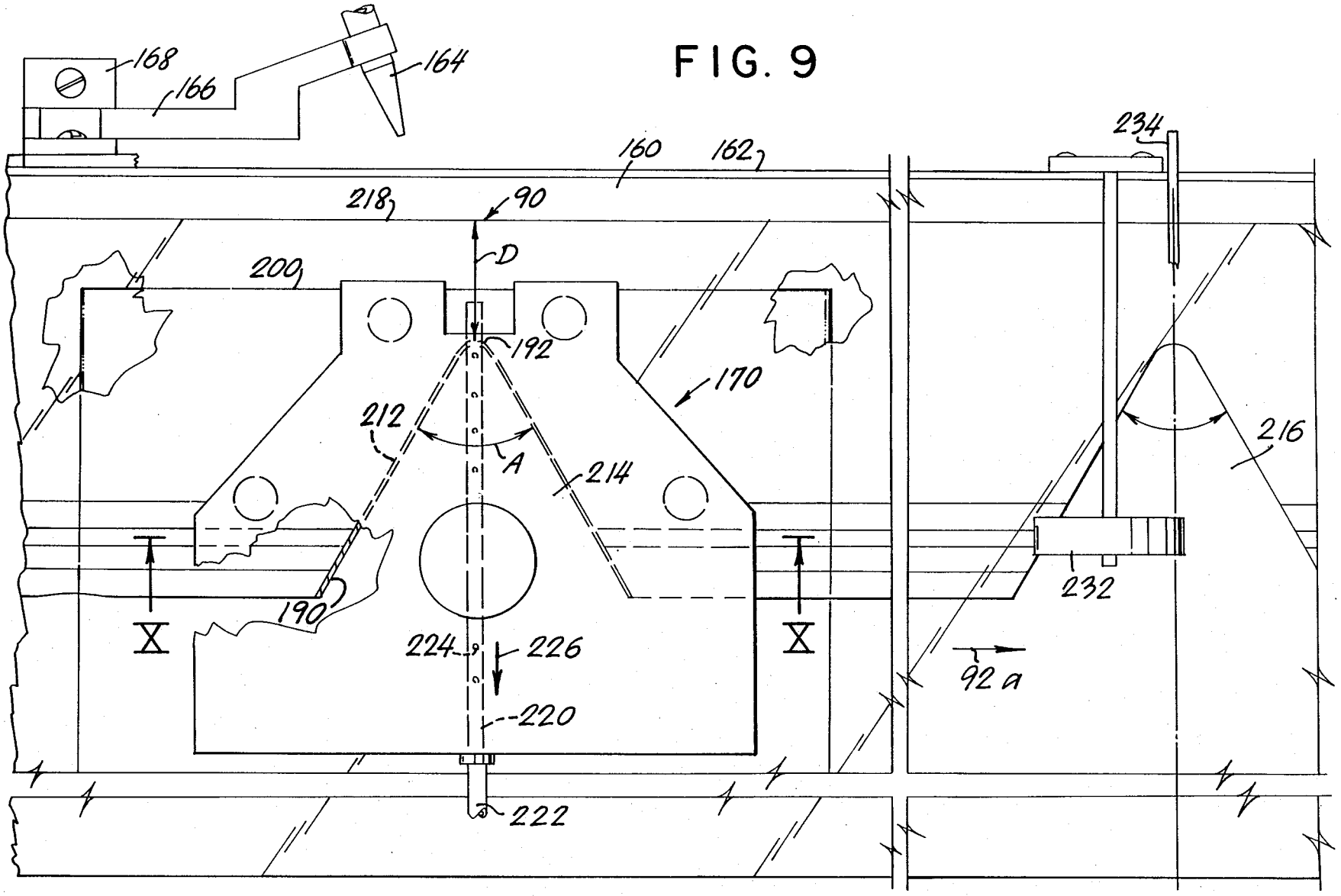
FIG. 9 is a top plan view partially diagrammatical, illustrating the cutting out of wedge shaped portions from the folded-over flap portion with the utilization of a template in accordance with the invention.
Figure 10:
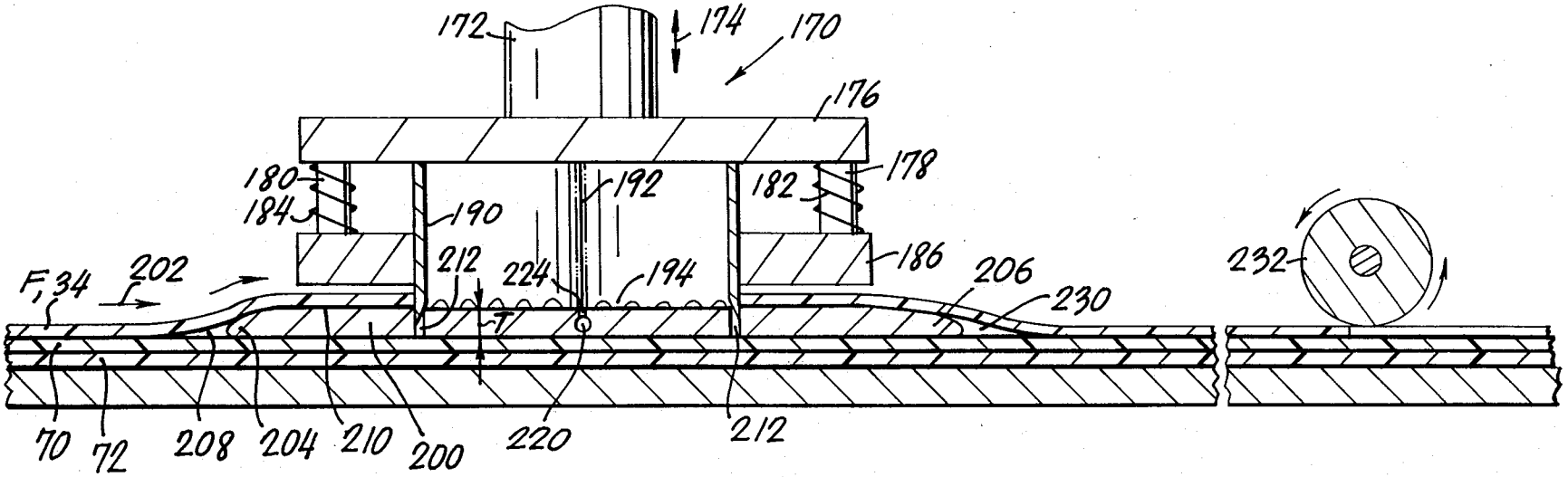
FIG. 10 is a side view, partially in section, illustrating the cutting out of wedge shaped notches by the use of a template and cutting tool in accordance with the invention.

FIG. 9, which is further illustrated by FIG. 10, illustrates the notching and sealing stations of the apparatus and methods of the invention. Therein is illustrated the film strip arrangement 90 longitudinally displaced in the direction indicated by arrow 92(a) indicating a continuation of the processing path referred. to hereinabove with reference to FIG. 6. In this figure is illustrated a table 160 having an edge 162 and supporting an air jet nozzle 164 supported by an arm 166 affixed to the edge of the table by a clamping mechanism 168.

Also indicated in FIG. 9 is the cutting station 170 which also appears in FIG. 10. Forming part of the cutting station is a piston and cylinder arrangement of which the piston is indicated at 172. This piston is reciprocable as indicated by arrow 174. The piston bears on the lower free end thereof a plate 176 having thereon posts as indicated at 178 and 180. These posts bear springs 182 and 184 which spring load a plate 186 slidably displaceable on the posts 178 and 180. The plate 186 supports a triangular knife 190 having its apex indicated at 192. This knife bears serrations forming a multiplicity of teeth indicated at 194.

An especially important port of the invention as relates to the method and apparatus thereof is the template which is employed. This template is indicated at 200. The function of the template is multifold. It provides for lifting the flap portion F, 34 away from the layer or film section 70, while at the same time accommodating the severing teeth of the cutting tool 190. The template also provides for blowing away the cut-out portions forming the notches which ultimately provide for the configuration of the flap portion 34 as illustrated in FIG. 1. To this end the template 200 is in its preferred form a rectangular sheet having a thickness T in the order of magnitude of about one eighth of an inch. The leading edge of the template as regards the path of travel 202 of the film strip arrangement being processed is indicated at 204. The trailing edge appears at 206. The flap portion F, 34 moves away from film strip section 70 at 208 and proceeds over the upper surface of template 200, as indicated at 210. To enable the template to function properly, it is provided with a coating of a selflubricating material such as Teflon. This Teflon permits the pressure-responsive adhesive to be separated readily and without destruction of the same.

With the flap portion F, 34 superposed above the upper surface 210 of template 200, the portion to be cut out is displaced to a position under the cutting tool 190. The template 200 accommodates penetration of the cutting teeth 194 of the cutting tool since the template is provided with a triangular groove indicated at 212. Thus the cutting teeth can penetrate below the upper surface 210 of the template thereby to remove a triangular-shaped notch as indicated at 214 and 216. More particularly, the cut-out portion and the notch itself are both symmetrical and preferably in the configuration of an isosceles triangle. The apex 192 of the cutting tool, and therefore of both the cut-away portion and the notch, is spaced from the edge 218 of the longitudinally displaced film arrangement by a distance indicated at D. This dimension determines the height of the rectangular portion 46 of the flap section 38, as illustrated in FIG. 1. This distance, which may be, for example, in the order of magnitude of one-quarter of an inch is variable within the scope of the invention and is subject to determination at will according to the requirements of the finished bag design. This latitude also applies to the shape and angle of the apex of the cut-away portion or notch, the cut-away portion preferably having, however, an apex angle lying within the range of from 15° to 60°. The apex angle is indicated at A.

To enable the removal of the cut-out portion formed by the reciprocation of the cutting tool into the above-described slot in template 200, the template is provided with a channel 220 to which is connected a source of compressed air as indicated at 222. From channel 220 extend a plurality of openings 224 which open through the upper surface 210 of the template and which are directed in inclined fashion in the direction of arrow 226. Air exiting through openings 224 serves to displace the cut-out portion from the remainder of the plastic film arrangement. This initial displacement is supplemented by a blast of air which is directed towards the cut-out portion by means of air jet nozzle 164. A vacuum arrangement (not shown) is furthermore provided which evacuates the sequential cut-out portions formed at the cutting station from the vicinity of the cutting station for purposes of disposal.

As the film arrangement continues along its path of processing, it descends over the trailing edge 206 of the template, as indicated at 230. It then passes beneath a roller 23 whereby the adhesive bond is restored and whereafter the arrangement with the cut-out notches 216 continues on its way to a sealing station diagrammatically indicated at 234. At this station is employed a conventional heated wire or sealing and cutting knife which is applied to the plastic arrangement transversely of the direction of movement thereof (and thus transversely of the path of processing). The sealing and cutting is arranged to bisect the cut-out notches 216 and to form laterally sealed edges in the resulting bags which are then in completed form. Printing operations may be effected at any desired stage along the processing path or prior thereto. An opening of the bottom edge of the respective bags will be automatically provided for if the initial film arrangement is constituted by two separate films which are brought into face-to-face relationship. As an alternative, the folded-over bottom edge, if such is employed, may be opened by means of a slitting arrangement.

In the aforegoing description, the arrangement of the cutting tool is such that the plate 180 is brought downwardly against the flap portion F, 34 for an instantaneous cutting operation. This operation takes place at a rate relative to the speed of travel of the film arrangement 90, such that little or no interference with the travel of the film arrangement occurs and such that the operation of downstream rollers, including the roller 23, may once again bring the film arrangement under tension, thereby to avoid distortion in the film arrangement 90.

Figure 11:
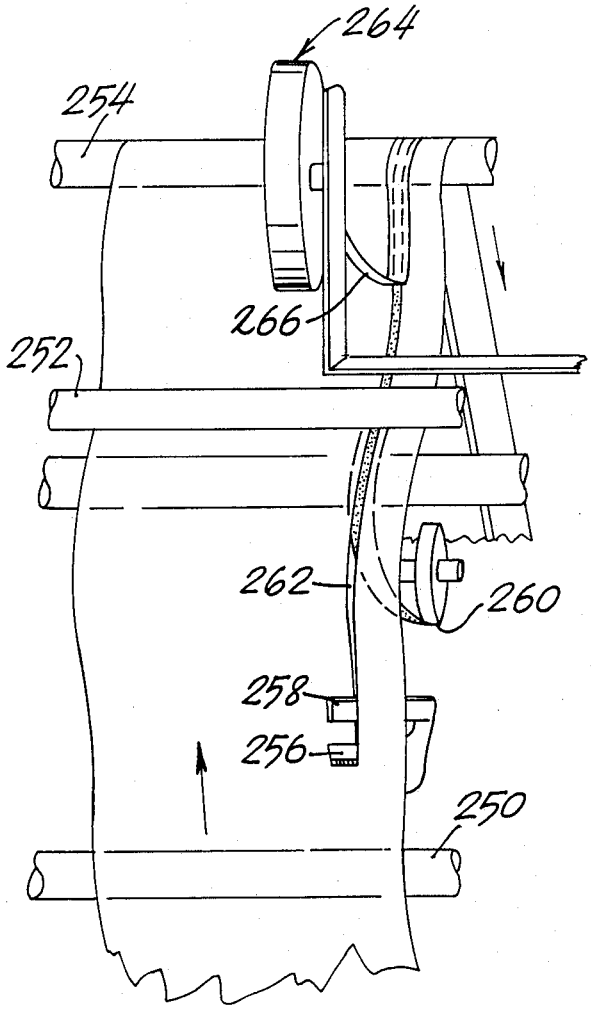
FIG. 11 is a view corresponding to FIG. 6 but showing a further embodiment of the invention.

FIG. 11 illustrates a modification of the equipment illustrated in FIG. 6 for purposes of applying a liner to conceal the exposed portion of the tape for the production of bags in the method in which this is considered desirable. Therein appears rollers 205, 252 and 254 with a cutting tool 256 and a spacer tool 258 provided in the manner generally indicated hereinabove. In this arrangement, the source of Scotch tape is indicated at 260 for purposes of exposing an adhesive through a gap 262. In this embodiment of the invention, there is further provided a source roll of liner material, such as plastic or paper. This source roll is indicated at 264 with the liner being drawn from the source roll as indicated at 266. Manual application of the liner 266 to the adhesive at set-up time is sufficient to provide for continued application of the linear to the exposed adhesive. In addition, an applicator idling rolled r(not shown) may furthermore be employed.

In the aforegoing, reference is made to Scotch tape (or the equivalent) in general. By way of example, this Scotch tape may be 0.002 inch thick Scotch tape with a 28 O.P.I. (ounces per inch) adhesive and with a tensile strength of 25. Such a tape is supplied by Devon Tape Corp. of North Bergen, N.J. through Norel Co. of North Bergen, N.J. as Norel 84ER. The tape substrate can be polypropylene or polyethylene and the adhesive can be, for example, acrylic or gum adhesive.

It will be noted from what has been stated above that there is provided a method of manufacturing bags with flaps comprising forming a plastic film into face-to-face film sections as shown in FIG. 6, for example, wherein it can be seen that one of the sections extends beyond the other of the sections as indicated at F. Thereafter this section is folded over said other section as mentioned above and as indicated in FIG. 7. Subsequently, notches are cut into the flap section to delineate separate flaps and associated bags. This is shown in FIGS. 9 and 10. Thereafter the bags are separated from each other.

Moreover, it will be seen in the aforegoing description that the flap section is connected to said other section with an adhesive before the cutting of the notches, and that a template is inserted between the flap section and said other section to permit the cutting of the notches while shielding said other section from damage. Still further it will be observed that the method comprises periodically trapping the flap section between the template and a cutting tool to effect the cutting of the notches sequentially in spaced relationship along the flap section.

It will also be observed from what has been described above that the invention involves as method comprising forming a bag with a mouth and a closeable but open zone spaced from the mouth as, for example, appears in FIG. 4. The mouth is closed with a flap and the goods to be packaged are inserted into the bag through the aforenoted open zone. The open zone is then closed such as by heat sealing to enclose the goods in the associated bag.

Further features of this method involve opening the flap an d rmeoving the goods through the thusly opened mouth when access to the goods is desired. The open zone, moreover, may be formed in an end of the bag which is opposite to said mouth. Since the bag is formed of plastic film, the aforesaid zone or open end may be closed by heat sealing or the like.

There will now be obvious to those skilled in the art many modifications and variations of the apparatus and methods disclosed hereinabove. These modifications and variations will not depart from the scope of the invention if defined by the following claims.

What is claimed is:

1. In a method of forming a bag from plastic film comprising forming a mouth and a flap to close said mouth, the improvement comprising separating the flap into separate sections spaced by a gap therebetween by continuously slitting the flap into said separate sections and controlling the size of the gap by interposing a spacer between said sections thereby displacing the sections from coplanar relationship, bring the sections into copolanar relationship, and connecting the sections with an adhesive bearing tape with the adhesive being exposed through the gap to adhere to said bag when the flap is folded over.

2. In a method of forming a bag from plastic film comprising forming a mouth and a flap to close said mouth, the improvement comprising separating the flap into separate sections spaced by a gap therebetween and connecting the sections with an adhesive which is exposed through the gap to adhere to said bag, further comprising forming the bag of two plastic film sections and hingedly connecting the flap to one of the film sections such that the adhesive is positioned to adhere to the other of said film sections, further comprising treating the surface of said other film section in correspondence with said adhesive to provide a surface which is ink receptive and to leave an area which is not ink receptive and which corresponds in position to the adhesive.

3. A method comprising longitudinally displacing first and second strips of plastic film along a processing path in face-to-face relation, the first strip being wider than the second strip and including a flap portion folded back along an edge portion of the second strip with a strip of adhesive bonding said flap portion to said edge portion, inserting a template between said flap portion and edge portion at a cutting station thereby elevating the adhesive from said edge portion, cutting wedge shaped notches into the flap portion by sandwiching the flap portion between the template and a cutting tool at said cutting station, pressing the flap portion and adhesive back against the edge portion, and sealing the film strips to each other along lines transverse to said path and in intersecting relation with said notches.

4. A method as claimed in claim 3 comprising blowing away the wedge shaped portions before sealing the film strip by the introduction of air between the flap portion and edge portion.

5. A method as claimed in claim 4, wherein said wedge shaped portions are at least partly blown away by blowing air through a channel formed in said template.

6. A method as claimed in claim 3, wherein the flap portion is divided into spaced flap sections separated by a gap, said method further comprising connecting the sections by a tape including a substrate with a pressure-responsive adhesive thereon which is exposed through said gap to constitute said strip of adhesive.

7. A method as claimed in claim 3, wherein the first film strip includes along a fold line, comprising cutting the wedge shaped notches from the flap portion at positions which are spaced from the fold line.

8. A method as claimed in claim 3, wherein the wedge shaped portions are formed as isosceles triangles.

9. A method as claimed in claim 3 comprising coating the template with Teflon.

10. A method of manufacturing bags with mouths and flaps to cover said mouths, comprising forming a plastic film into face-to-face sections, one of the sections including a portion extending beyond the other of the sections, folding said portion over said other section to form a flap section, and, subsequent to said folding, cutting notches into the flap section to delineate separate flaps and associated bags, and then separating the bags from each other, said method further comprising connecting the flap section to said other section with an adhesive before the cutting of said notches, then inserting a template between the flap section and said other section to permit the cutting of the notches while shielding said other section and to raise the adhesive from said other section, and then pressing the adhesive back against said other section.

11. A method of manufacturing bags with flaps as claimed in claim 10, comprising periodically trapping the flap section between the template and a cutting tool to effect the cutting notches sequentially in spaced relation along the flap section while the flap section is opposed to said other section.

* * * * *